US010421101B2

(12) United States Patent
Hoefler et al.

(10) Patent No.: US 10,421,101 B2
(45) Date of Patent: Sep. 24, 2019

(54) TAMPING UNIT FOR TAMPING SLEEPERS OF A TRACK

(71) Applicant: PLASSER & THEURER EXPORT VON BAHNBAUMASCHINEN GESELLSCHAFT M.B.H., Vienna (AT)

(72) Inventors: Florian Hoefler, Rohrbach (AT); Gerhard Hoellinger, St. Florian (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 243 days.

(21) Appl. No.: 15/543,128

(22) PCT Filed: Jan. 30, 2016

(86) PCT No.: PCT/EP2016/000157
§ 371 (c)(1),
(2) Date: Jul. 12, 2017

(87) PCT Pub. No.: WO2016/134817
PCT Pub. Date: Sep. 1, 2016

(65) Prior Publication Data

US 2017/0348731 A1 Dec. 7, 2017

(30) Foreign Application Priority Data

Feb. 27, 2015 (AT) ..... A 106/2015

(51) Int. Cl.
*B06B 1/18* (2006.01)
*E01B 27/16* (2006.01)

(52) U.S. Cl.
CPC ..... *B06B 1/18* (2013.01); *E01B 27/16* (2013.01)

(58) Field of Classification Search
CPC ..... E01B 27/16; B06B 1/18; B06B 1/183
USPC ..... 104/12
See application file for complete search history.

(56) References Cited

U.S. PATENT DOCUMENTS

| | | | |
|---|---|---|---|
| 3,981,247 | A | 9/1976 | Theurer |
| 4,068,595 | A | 1/1978 | Weber et al. |
| 4,240,352 | A | 12/1980 | Theurer |

(Continued)

FOREIGN PATENT DOCUMENTS

| | | | |
|---|---|---|---|
| AT | 339358 | B | 10/1977 |
| EP | 0331956 | A2 | 9/1989 |
| WO | 2014063770 | A1 | 5/2014 |

*Primary Examiner* — Zachary L Kuhfuss
(74) *Attorney, Agent, or Firm* — Laurence A. Greenberg; Werner H. Stemer; Ralph E. Locher

(57) ABSTRACT

A tamping unit includes tamping tines and a squeezing drive for squeezing the tamping tines. A vibration exciter has an outer cylinder and an inner cylinder. The inner cylinder is disposed coaxially to a cylinder axis and is mounted for displacement in an axial direction along sliding or gliding surfaces in the outer cylinder. A ring-shaped recess is provided between the two sliding or gliding surfaces which are spaced from one another in the axial direction. A spacer ring, which subdivides the ring-shaped recess into two fluid channels, is connected selectively to the inner or outer cylinder. The fluid channels are spaced from one another relative to the axial direction. The two fluid channels can be hydraulically actuated alternatingly by feed lines for vibration excitation.

10 Claims, 2 Drawing Sheets

(56) References Cited

U.S. PATENT DOCUMENTS

| | | | | |
|---|---|---|---|---|
| 4,942,821 | A * | 7/1990 | Rossanigo | E01B 27/16 104/12 |
| 2006/0090666 | A1* | 5/2006 | Theurer | E01B 27/16 104/12 |
| 2015/0267355 | A1 | 9/2015 | Hofstaetter | |
| 2016/0153150 | A1* | 6/2016 | Salciccia | B06B 1/18 104/12 |
| 2017/0348731 | A1* | 12/2017 | Hoefler | E01B 27/16 |
| 2018/0274178 | A1* | 9/2018 | Steiner | E01B 27/16 |
| 2018/0297081 | A1* | 10/2018 | Philipp | B06B 1/18 |
| 2018/0298563 | A1* | 10/2018 | Sami | E01B 27/16 |

* cited by examiner

TAMPING UNIT FOR TAMPING SLEEPERS OF A TRACK

BACKGROUND OF THE INVENTION

Field of the Invention

The invention relates to a tamping unit for tamping sleepers of a track, including a tine carrier which is mounted for vertical adjustment on an assembly frame and on which are supported tamping tines which are pivotable towards one another by means of a respective hydraulic squeezing drive which has a cylinder axis and is connected to a vibration exciter.

Tamping units for tamping sleepers of a track are already widely known, for example from U.S. Pat. No. 4,240,352, AT 339 358, EP 0 331 956 or U.S. Pat. No. 4,068,595. The vibrations of the vibration exciter acting upon the tamping tines can be produced either by an eccentric shaft or by hydraulic impulses in a linear drive which simultaneously also carries out the squeezing motions of the tamping tines.

SUMMARY OF THE INVENTION

It is the object of the present invention to provide a tamping unit of the type mentioned at the beginning with which an improved vibration of the tamping tines is possible.

According to the invention, this object is achieved with a tamping unit of the specified kind by way of the features cited in the characterizing part of the main claim.

A hydraulic-based vibration exciter of this kind has the advantage that functionally a clear separation between the generating of vibrations, on the one hand, and the squeezing motion for the tamping tines, on the other hand, can be achieved. Additionally, the control effort for producing the vibrations can be simplified.

Additional advantages of the invention become apparent from the dependent claims and the drawing description.

BRIEF DESCRIPTION OF THE SEVERAL VIEWS OF THE DRAWING

The invention will be described in more detail below with reference to embodiments represented in the drawing in which.

DESCRIPTION OF THE INVENTION

Figure 1:
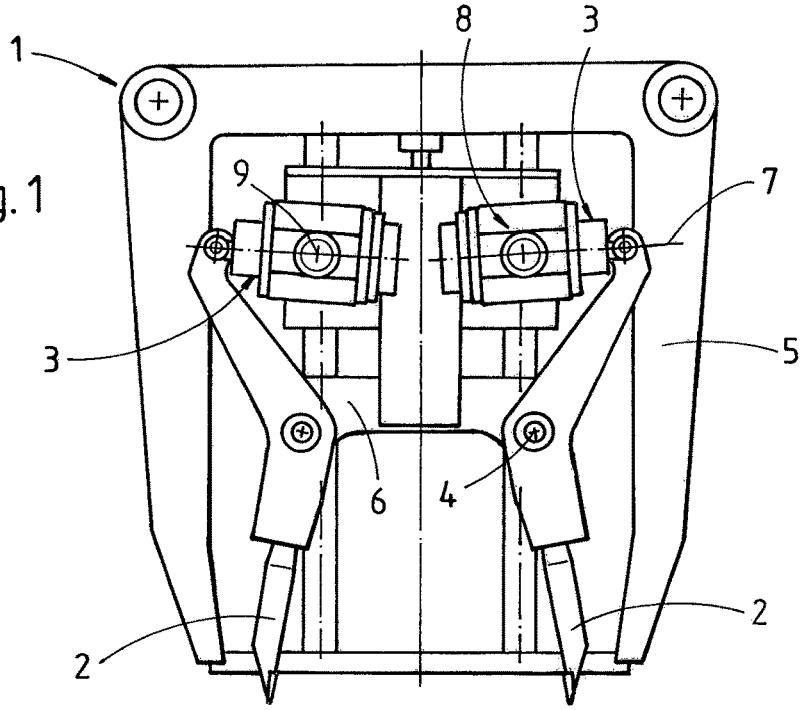
FIG. 1 shows a side view of a tamping unit having squeezing drives as well as vibration exciters, FIGS. 2 to 4 each show simplified representations of a vibration exciter including hydraulic circuit diagram.

A tamping unit 1, shown in FIG. 1, for tamping sleepers of a track has two tamping tines 2 which, for compaction of ballast, are movable towards one another in each case in pincer-like fashion with the aid of a squeezing drive 3. Each tamping tine 2 is mounted for pivoting about a pivot axis 4 on a tine carrier 6 which is vertically adjustable relative to an assembly frame 5. Associated with each squeezing drive 3 having a cylinder axis 7 is a hydraulic-based vibration exciter 8 for producing vibrations superimposed on a squeezing motion of the tamping tines 2. The squeezing drive 3 is fastened to the tine carrier 6 for pivoting about a bearing axis 9.

Figure 2:
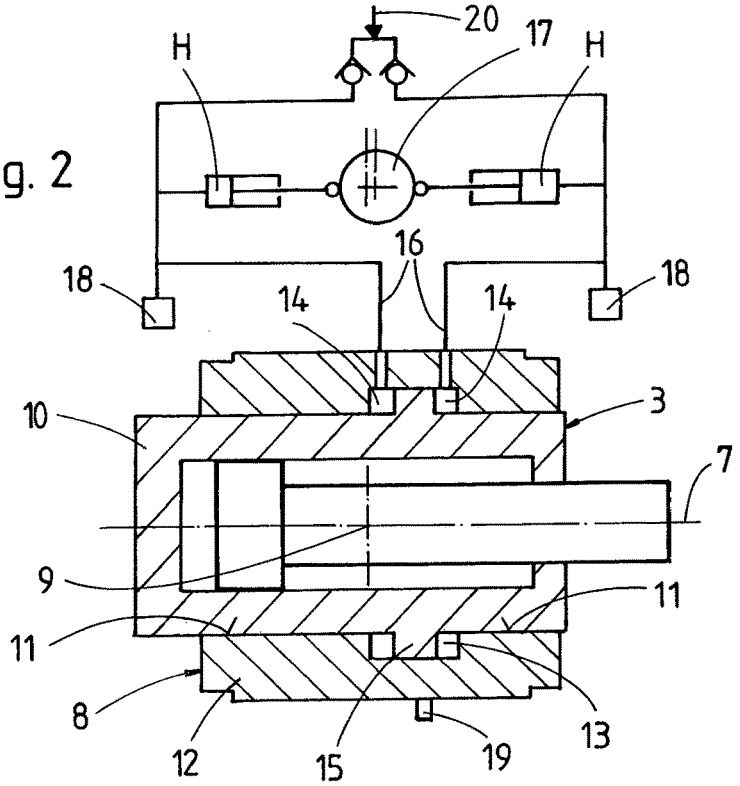

A cross-section of the squeezing drive 3, depicted in FIG. 2, shows an inner cylinder 10—arranged coaxially to the cylinder axis 7—of the vibration exciter 8 which, in this particular embodiment of the invention, serves simultaneously also as a squeezing drive 3 composed of hydraulic cylinder and cylinder piston. The inner cylinder 10 (or the squeezing drive 3) is mounted for displacement in the axial direction 7 via sliding surfaces 11 in an outer cylinder 12.

A ring-shaped recess 13 is provided in the outer cylinder 12 between two sliding surfaces 11 spaced from one another in the direction of the cylinder axis 7 (axial direction). A spacer ring 15 subdividing said ring-shaped recess 13 into two fluid channels 14—spaced from one another with regard to the axial direction 7—is connected to the inner cylinder 10. The two fluid channels 14 can be hydraulically actuated alternatingly via supply lines 16 for vibration excitation of the inner cylinder 10, i.e. the squeezing drive 3 (for the sake of simplicity, the supply lines required for the squeezing motion of the squeezing drive 3 are not shown).

By way of the indicated bearing axle 9, the outer cylinder 12 of the vibration exciter 8 is articulatedly connected directly (and thus the squeezing drive 3 indirectly) to the tine carrier 6. The alternating actuation of the two fluid channels 14, each connected to the supply lines 16, takes place via a double-piston pump 17 which is phase-shifted by 180°.

A vibration amplitude of the tamping tines 2 is defined by a displacement volume H of the double-piston pump 17 and the volume of the two fluid channels 14. A change of the displacement volume H is possible by adjustment of the eccentric path on the double-piston pump 17. The vibration frequency of the tamping tines 2 corresponds to the stroke frequency of the double-piston pump 17 (or the rotational speed n of an eccentric shaft). The vibration frequency can be adjusted from 0 to 60 Hz by changing the rotational speed of the eccentric shaft. The stroke and return stroke of the inner cylinder 10 (or the squeezing drive 3) are carried out via the double-piston pump 17 which is phase-shifted by 180°. The vibration amplitude of the tamping tines 2 as a function of the striking power can be adjusted via a proportional pressure control valve 18. By means of the latter, it is also possible to interrupt the tamping tine vibration, as desired, without having to switch off the drive of the double-piston pump 17 for this purpose.

In the illustrated variant of embodiment of a "combination cylinder", it is possible without problems to unite the functions "tamping tine squeezing" and "tamping tine vibration" in a compact design and while keeping to customary installation dimensions of squeezing cylinders in tamping units.

In the region of the sliding surface 11 of the spacer ring 15, the outer cylinder 12 of the vibration exciter 8 has an outlet opening 19 for leakage oil escaping from the two fluid channels 14, which is replenished via a feed line 20. Thus it is possible to continuously renew the oil which heats up intensely through the vibrations.

Figure 3:
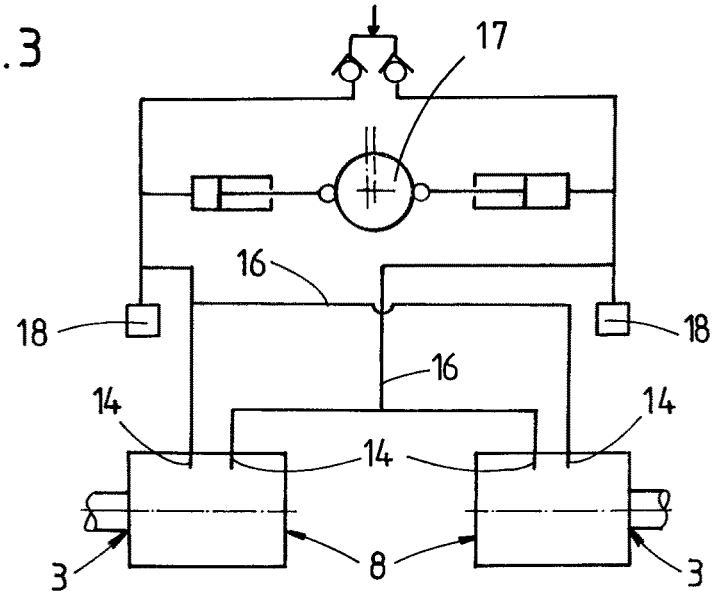

As visible in a variant represented by FIG. 3, the two fluid channels 14 of the two vibration exciters 8 which are facing towards one another, on the one hand, and the two fluid channels 14 facing away from one another, on the other hand, can be actuated in each case by a common feed line 16. The latter provides for pressure compensation between the vibration drives. Thus, the vibration amplitude attunes itself proportionally to the load pressure (vibration resistance). The result is so-called asynchronous tamping (having the effect that a higher amplitude occurs on the side with smaller vibration resistance).

Figure 4:
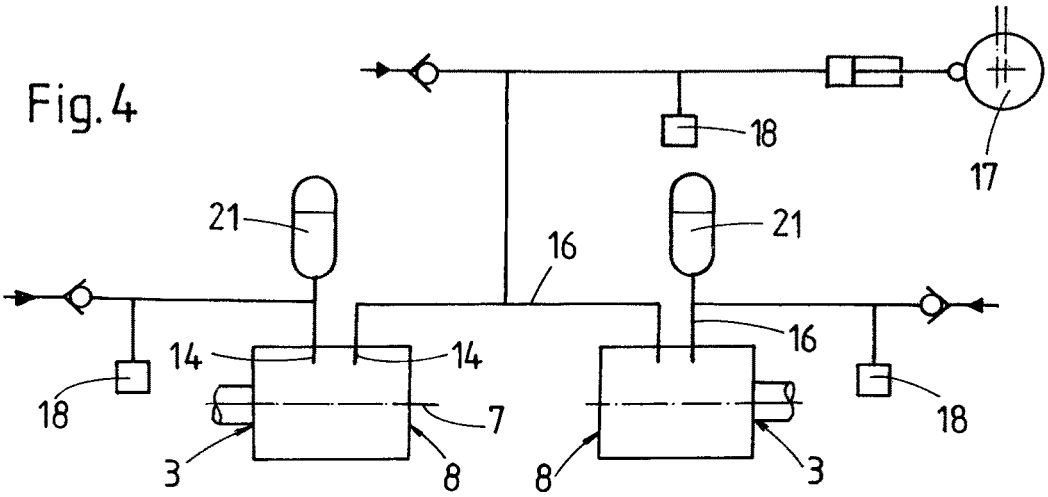

According to a variant of embodiment visible in FIG. 4, one of the two feed lines 16 of the vibration exciter 8 can be actuated by the double-piston pump 17, and the other one by a respective hydraulic accumulator 21. This hydraulic spring, configured as a membrane- or piston accumulator, is defined via the gas filling- and preload pressure.

In principle, any known manner of producing a pulsating fluid stream can, of course, be used for the vibration exciter 8. For example, instead of the piston pump, a proportional valve fastened preferably directly to the vibration exciter 8 could be provided.

Figure 5:
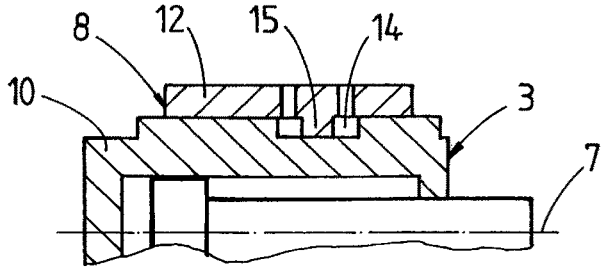
FIG. 5 shows a further variant of a squeezing drive.

According to the variant shown in FIG. 5, the spacer ring 15 is connected to the outer cylinder 12 while the fluid channel 14 is provided in the inner cylinder 10 or squeezing drive 3.

The invention claimed is:

1. A tamping unit for tamping sleepers of a track, the tamping unit comprising:

an assembly frame;

a tine carrier mounted for vertical adjustment on said assembly frame;

tamping tines supported on said tine carrier;

hydraulic squeezing drives each pivoting a respective one of said tamping tines towards another of said tamping tines and each having a cylinder axis defining an axial direction;

a vibration exciter connected to said hydraulic squeezing drives, said vibration exciter having an outer cylinder and an inner cylinder;

said outer cylinder having two gliding surfaces spaced apart from one another in said axial direction and a ring-shaped recess between said two gliding surfaces;

said inner cylinder being disposed coaxially to said cylinder axis and being mounted for displacement in said axial direction along said gliding surfaces of said outer cylinder;

said inner cylinder or said outer cylinder having a spacer ring subdividing said ring-shaped recess into two fluid channels being spaced from one another relative to said axial direction; and feed lines for alternatingly hydraulically actuating said two fluid channels for vibration excitation.

2. The tamping unit according to claim 1, wherein said inner cylinder is formed by said squeezing drives for pivoting said tamping tines.

3. The tamping unit according to claim 1, wherein said outer cylinder has an outlet opening for leaking oil escaping from said fluid channels, said outlet opening being disposed in a region of one of said gliding surfaces and said spacer ring.

4. The tamping unit according to claim 1, wherein each of said tamping tines has a respective pivot axis, and said outer cylinder is fastened to said tine carrier for pivoting about a bearing axis extending parallel to said respective pivot axes.

5. The tamping unit according to claim 1, which further comprises a double-piston 180° phase-shifted hydraulic pump connected to said feed lines for the alternating actuation of said fluid channels.

6. The tamping unit according to claim 5, which further comprises proportional pressure control valves each being associated with a respective one of said feed lines.

7. The tamping unit according to claim 1, wherein said tamping tines are two tamping tines being squeezable towards one another in a tamping tine pair, and said vibration exciter is one of two separate vibration exciters each being associated with a respective one of said two tamping tines.

8. The tamping unit according to claim 7, which further comprises a double-piston pump being commonly connected to said fluid channels of both of said vibration exciters for actuation.

9. The tamping unit according to claim 7, wherein said fluid channels of said two vibration exciters include two fluid channels facing towards one another being actuated in common by one of said feed lines and two fluid channels facing away from one another being actuated in common by another of said feed lines.

10. The tamping unit according to claim 1, which further comprises a hydraulic accumulator actuating one of said feed lines, and a double-piston pump actuating another of said feed lines.

* * * * *